US010047991B2

(12) United States Patent
Kim et al.

(10) Patent No.: US 10,047,991 B2
(45) Date of Patent: Aug. 14, 2018

(54) HEAT PUMP

(71) Applicant: LG ELECTRONICS INC., Seoul (KR)

(72) Inventors: Kidong Kim, Seoul (KR); Jongchul Ha, Seoul (KR); Jiwon Chang, Seoul (KR); Hyunjong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 312 days.

(21) Appl. No.: 14/719,812

(22) Filed: May 22, 2015

(65) Prior Publication Data

US 2015/0338145 A1 Nov. 26, 2015

(30) Foreign Application Priority Data

May 22, 2014 (KR) ..... 10-2014-0061749

(51) Int. Cl.
*F25B 1/00* (2006.01)
*F25B 49/00* (2006.01)
(Continued)

(52) U.S. Cl.
CPC ..... *F25B 49/022* (2013.01); *F25B 6/02* (2013.01); *F25B 7/00* (2013.01); *F25B 13/00* (2013.01);
(Continued)

(58) Field of Classification Search
CPC .... F25B 6/02; F25B 30/02; F25B 7/00; F25B 40/02; F25B 2313/0254; F25B 25/005; F25D 21/12
See application file for complete search history.

(56) References Cited

U.S. PATENT DOCUMENTS 3,392,541 A 7/1968 Nussbaum
2010/0170295 A1* 7/2010 Okazaki ..... F04C 18/0215 62/510
(Continued)

FOREIGN PATENT DOCUMENTS

CN 1877221 12/2006
CN 1886625 12/2006
(Continued)

OTHER PUBLICATIONS

European Search Report dated Oct. 25, 2016 issued in Application No. 15168890.0.
(Continued)

*Primary Examiner* — Len Tran
*Assistant Examiner* — Kamran Tavakoldavani
(74) *Attorney, Agent, or Firm* — KED & Associates, LLP

(57) ABSTRACT

A heat pump includes a first cycle device and a second cycle device. The first cycle device is connected such that, in a heating operation, a first refrigerant is circulated in an order of a first compressor, a 4-way valve, a first heat exchanger, a second heat exchanger, a first expansion mechanism, a third heat exchanger, the 4-way valve, and the first compressor, and such that, in a cooling operation, the first refrigerant is circulated in an order of the first compressor, the 4-way valve, the third heat exchanger, the first expansion mechanism, the second heat exchanger, the first heat exchanger, the 4-way valve, and the first compressor. The second cycle device is connected such that a second refrigerant is circulated in an order of a second compressor, a fourth heat exchanger, a second expansion mechanism, the second heat exchanger, and the second compressor.

20 Claims, 7 Drawing Sheets

(51) Int. Cl.

| | |
|---|---|
| ***F25B 49/02*** | (2006.01) |
| ***F25D 21/12*** | (2006.01) |
| ***F25B 6/02*** | (2006.01) |
| ***F25B 30/02*** | (2006.01) |
| ***F25B 7/00*** | (2006.01) |
| ***F25B 13/00*** | (2006.01) |
| ***F25B 47/02*** | (2006.01) |

(52) U.S. Cl.
CPC ..... *F25B 30/02* (2013.01); *F25B 47/02* (2013.01); *F25D 21/12* (2013.01); *F25B 49/02* (2013.01); *F25B 2313/0254* (2013.01); *F25B 2600/0251* (2013.01)

(56) References Cited

U.S. PATENT DOCUMENTS

2010/0282434 A1* 11/2010 Yabuuchi ..... F24D 11/0235 165/63
2012/0216989 A1* 8/2012 Wakamoto ..... F25B 13/00 165/96
2013/0061622 A1* 3/2013 Kubota ..... F25B 7/00 62/238.6
2013/0145786 A1* 6/2013 Tamaki ..... F25B 13/00 62/161
2014/0047857 A1* 2/2014 Sao ..... F24F 1/24 62/259.2

FOREIGN PATENT DOCUMENTS

| | | |
|---|---|---|
| CN | 101203383 | 6/2008 |
| CN | 201237397 U | 5/2009 |
| CN | 102466374 | 5/2012 |
| CN | 102997477 | 3/2013 |
| EP | 2 447 622 A2 | 5/2012 |
| WO | WO 2013/027757 A1 | 2/2013 |

OTHER PUBLICATIONS

Chinese Office Action dated Jan. 23, 2017 issued in Application No. 201510262533.1 (with English translation).

* cited by examiner

HEAT PUMP

CROSS-REFERENCE TO RELATED APPLICATION

This application claims priority under 35 U.S.C. § 119 to Korean Application No. 10-2014-0061749 filed on May 22, 2014, whose entire disclosure is hereby incorporated by reference.

BACKGROUND

1. Field

The present disclosure relates to a heat pump, and more specifically, to a heat pump capable of performing continuous heating.

2. Background

In general, a heat pump is a cooling and heating apparatus that transfers a heat source at a low temperature to a high temperature or transfers a heat source at a high temperature to a low temperature by using heating or condensing of a refrigerant. A heat pump may include a compressor, an outdoor heat exchanger, an expansion mechanism, and an indoor heat exchanger. The heat pump may cool or heating the interior of the room.

In a cooling operation of the heat pump, the outdoor heat exchanger may function as a condenser and the indoor heat exchanger may function as an evaporator. In a heating operation of the heat pump, the indoor heat exchanger may function as a condenser and the outdoor heat exchanger may function as an evaporator.

When the compressor is driven in the heat pump, moisture in air is condensed on the surface of the outdoor heat exchanger, and therefore, condensed water may be generated. The generated water is cooled by ambient air at a low temperature, and therefore, frost may be formed on the surface of the outdoor heat exchanger. In this case, the outdoor heat exchanger does not perform smooth heat exchange between a refrigerant and air, and hence the performance of the outdoor heat exchanger may be degraded.

As an example for delaying frost formation or removing frost, the heat pump may stop the driving of the compressor during an operation of the heat pump and heat the outdoor heat exchanger by using a defrosting heater separately provided near the outdoor heat exchanger.

As another example for delaying frost formation or removing frost, the heat pump may stop heating during a heating operation of the heat pump and operate in a cooling mode, to separately perform a defrosting operation of removing frost on the surface of the outdoor heat exchanger. If the defrosting of the outdoor heat exchanger is terminated, the heat pump may stop the defrosting operation and then return to the heating operation.

In another example for delaying frost formation or removing frost, when the refrigerator at a low temperature, expanded by the expansion mechanism, passes through some flow paths of the outdoor heat exchanger, the heat pump may allow the refrigerator at a high temperature to pass through the other flow paths of the outdoor heat exchanger, thereby partially defrosting the outdoor heat exchanger.

In the heat pump according to the background art, a separate defrosting heater is required, continuous heating is not performed because a heating operation is temporarily stopped, or a flow path structure for partially defrosting a heat exchanger is complicated.

BRIEF DESCRIPTION OF THE DRAWINGS

The embodiments will be described in detail with reference to the following drawings in which like reference numerals refer to like elements wherein.

DETAILED DESCRIPTION

Figure 1:
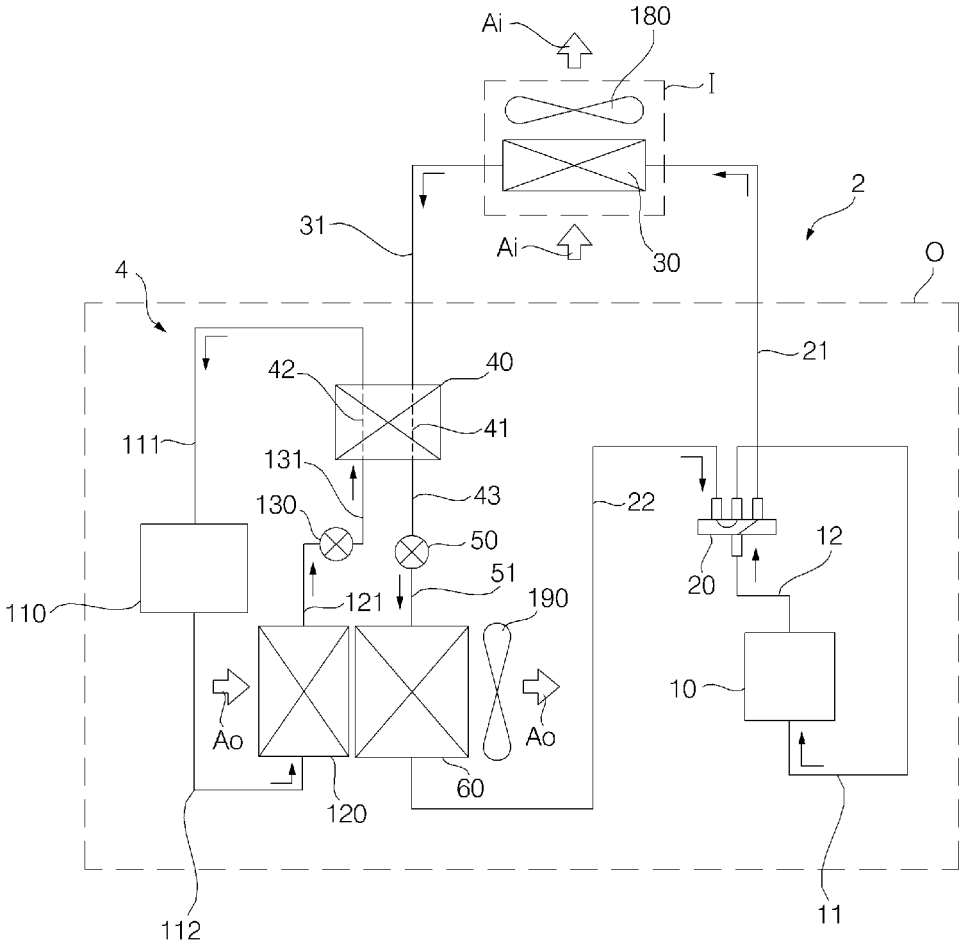
FIG. 1 is a diagram illustrating a flow of a refrigerant in a heating operation of a heat pump according to a first embodiment of the present disclosure.
Figure 2:
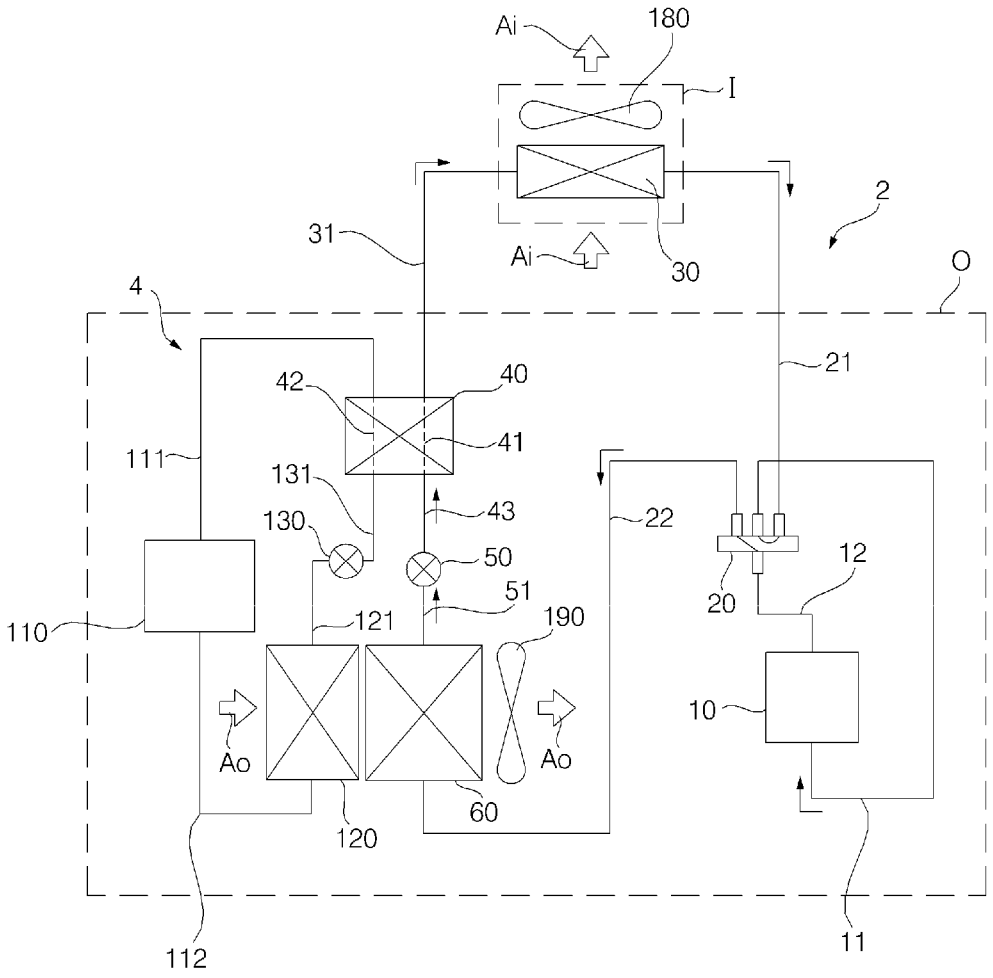
FIG. 2 is a diagram illustrating a flow of the refrigerant in a cooling operation of the heat pump according to the first embodiment of the present disclosure.
Figure 3:
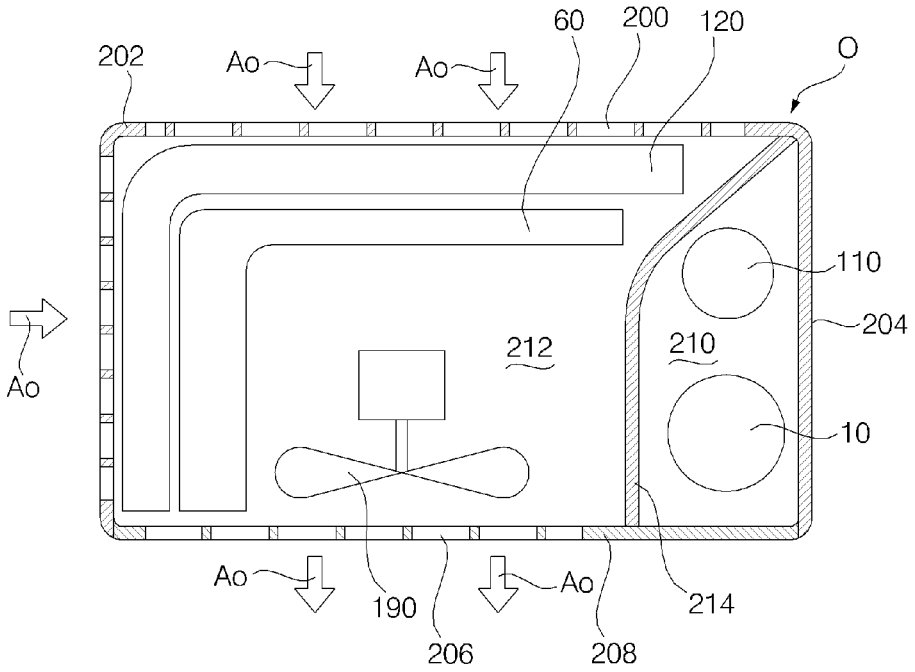
FIG. 3 is a diagram illustrating an inside of an outdoor unit in the heat pump according to the first embodiment of the present disclosure.
Figure 4:
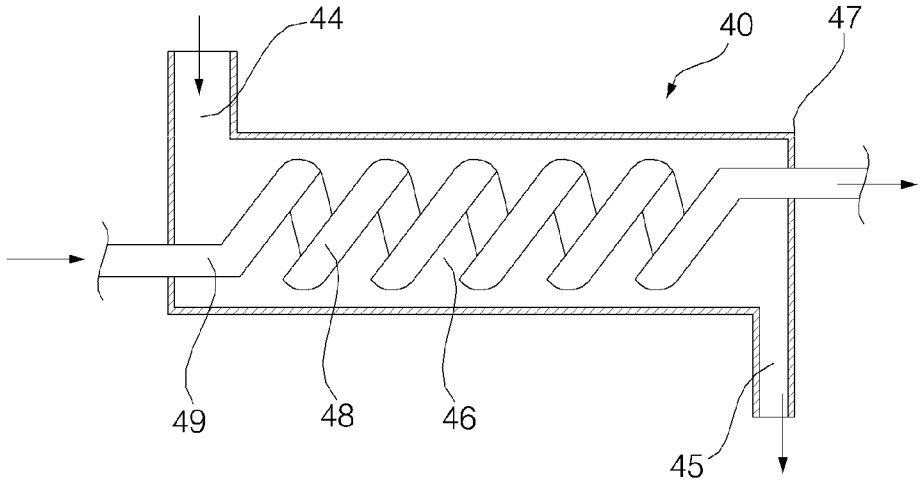
FIG. 4 is a diagram illustrating an inside of a second heat exchanger in the heat pump according to the first embodiment of the present disclosure.

FIG. 1 is a diagram illustrating a flow of a refrigerant in a heating operation of a heat pump according to a first embodiment of the present disclosure. FIG. 2 is a diagram illustrating a flow of the refrigerant in a cooling operation of the heat pump according to the first embodiment of the present disclosure. FIG. 3 is a diagram illustrating an inside of an outdoor unit in the heat pump according to the first embodiment of the present disclosure. FIG. 4 is a diagram illustrating an inside of a second heat exchanger in the heat pump according to the first embodiment of the present disclosure.

The heat pump of this embodiment includes a first cycle device 2 in which a first refrigerant is circulated, and a second cycle device 4 in which a second refrigerant heat-exchanged with the first refrigerant of the first cycle device 2 is circulated. The first cycle device 2 may be a cooling cycle device including a first compressor 10, a 4-way valve 20, a first heat exchanger 30, a second heat exchanger 40, a first expansion mechanism 50, and a third heat exchanger 60.

The first cycle device 2 may be connected such that the first refrigerant is circulated in an order of the first compressor 10, the 4-way valve 20, the first heat exchanger 30, the second heat exchanger 40, the first expansion mechanism 50, the third heat exchanger 60, the 4-way valve 20, and the first compressor 10. In driving of the first compressor 10, the first refrigerant may be condensed in the first heat exchanger 30 and evaporated in the third heat exchanger 60. In this case, the first cycle device 2 may perform a heating operation in which the first refrigerant heats indoor air or water. Any one of the first and second heat exchangers 30 and 40 may function as a heat exchanger for heating the interior of a room or function as a hot-water supply heat exchanger for generating hot water.

As shown in FIG. 2, the first cycle device 2 may be connected such that the first refrigerant is circulated in an order of the first compressor 10, the 4-way valve 20, the third heat exchanger 60, the first expansion mechanism 50, the second heat exchanger 40, the first heat exchanger 30, the 4-way valve 20, and the first compressor 10. In driving of the first compressor 10, the first refrigerant may be condensed in the third heat exchanger 60 and evaporated in the first heat exchanger 30. In this case, the first cycle device 2 may perform a cooling operation of cooling indoor air or water. Any one of the first and second heat exchangers 30 and 40 may function as a heat exchanger for cooling the interior of a room or function as a cooling heat exchanger for generating cold water.

The first compressor 10 may suck the first refrigerant, compress the sucked refrigerant, and then exhaust the compressed refrigerant. A first compressor suction line 11 through which the first refrigerant is sucked into the first compressor 10 may be connected to the first compressor 10. One end of the first compressor suction line 11 may be connected to the first compressor 10, and the other end of the first compressor suction line 11 may be connected to the 4-way valve 20. The 4-way valve 20 may guide the first refrigerant into the first compressor suction line 11, and the first refrigerant flowed into the first compressor suction line 11 may be sucked into the first compressor 10 to be compressed in the first compressor 10. An accumulator in which liquid refrigerant in the first refrigerant is contained may be installed in the first compressor suction line 11.

A first compressor exhaust line 12 through which the first refrigerant compressed by the first compressor 10 is exhausted may be connected to the first compressor 10. One end of the first compressor exhaust line 12 may be connected to the first compressor 10, and the other end of the first compressor exhaust line 12 may be connected to the 4-way valve 20. The first compressor 10 may exhaust the first refrigerant into the first compressor exhaust line 12, and the first refrigerant exhausted into the first compressor exhaust line 12 may be flowed into the 4-way valve 20 to be guided by the 4-way valve. An oil separator for separating oil mixed in the exhausted first refrigerant may be installed in the first compressor exhaust line 12. A check valve for preventing the first refrigerant from flowing back to the first compressor 10 may be installed in the first compressor exhaust line 12.

The 4-way valve 20 may be a cooling/heating switching valve for switching between cooling and heating operations. The 4-way valve 20 may be connected to the first heat exchanger 30 through a 4-way valve-first heat exchanger connecting line 21. The 4-way valve 20 may be connected to the third heat exchanger through a 4-way valve-third heat exchanger connecting line 22.

In a heating operation, the 4-way valve 20 may guide the first refrigerant exhausted into the first compressor exhaust line 12 into the 4-way valve-first heat exchanger connecting line 21 and guide the first refrigerant flowed in the third heat exchanger 60 into the first compressor suction line 11.

In a cooling operation, the 4-way valve 20 may guide the first refrigerant exhausted into the first compressor exhaust line 12 into the 4-way valve-third heat exchanger connecting line 22 and guide the first refrigerant flowed in the first heat exchanger 30 into the first compressor suction line 11.

Any one of the first and second heat exchangers 30 and 40 may be a heat exchanger for heat-exchanging the first refrigerant with air or water. The other of the first and second heat exchangers 30 and 40 may be a first refrigerant-second refrigerant heat exchanger having a first refrigerant flow path 41 through which the first refrigerant passes and a second refrigerant flow path 42 through which the second refrigerant is heat-exchanged with the first refrigerant while passing.

In this embodiment, the first heat exchanger 30 is a heat exchanger for heat-exchanging the first refrigerant with indoor air or water, and the second heat exchanger 40 is a first refrigerant-second refrigerant heat exchanger for heat-exchanging the first and second refrigerants with each other.

As an example, the first heat exchanger 30 may be a first refrigerant-indoor air heat exchanger for heat-exchanging the first refrigerant with indoor air. The first heat exchanger 30 may be an indoor heat exchanger for heat-exchanging indoor air Ai with the first refrigerant.

As another example, the first heat exchanger 30 may be a first refrigerant-water heat exchanger for allowing the first refrigerant to heat water. In a case where a water pipe is connected to the first heat exchanger 30, the first heat exchanger 30 may be a hot-water supply heat exchanger for heating water used to supply hot water.

The heat pump may be configured as a separate type air conditioner having an indoor unit I and an outdoor unit O to air condition the interior of a room, and the first heat exchanger 30 may be disposed in the indoor unit I. The heat pump may further include an indoor fan 180 for blowing the indoor air Ai to the first heat exchanger 30. The first heat exchanger 30 and the indoor fan 180 may be disposed together in the indoor unit I. In driving of the indoor fan 180, the indoor air Ai may be sucked into the indoor unit I to be heat-exchanged with the first heat exchanger 30 and then exhausted to the interior of the room.

In a heating operation of the heat pump, the first heat exchanger 30 may be a condenser in which the first refrigerant compressed by the first compressor 10 is heat-exchanged with the indoor air Ai to be evaporated. In a cooling operation of the heat pump, the first heat exchanger 30 may be an evaporator in which the first refrigerant expanded by the first expansion mechanism 50 is heat-exchanged with the indoor air Ai to be evaporated. The first heat exchanger 30 may be configured as a refrigerant-air heat exchanger for heat-exchanging the first refrigerant with air. The first heat exchanger 30 may be configured as a fin-tube type heat exchanger including a refrigerant tube through which the first refrigerant passes and fins installed in the refrigerant tube.

The first and second heat exchangers 30 and 40 may be connected to each other through a first heat exchanger-second heat exchanger connecting line 31. The first heat exchanger-second heat exchanger connecting line 31 may be connected to the first refrigerant flow path 41 of the second heat exchanger 40.

The second heat exchanger 40 may heat-exchange the first and second refrigerants with each other. The second heat exchanger 40 may be a cascade heat exchanger for absorbing heat of the first refrigerant and transferring the absorbed heat to the second cycle device 4. The second heat exchanger 40 may be configured as a first refrigerant-second refrigerant heat exchanger for heat-exchanging the first refrigerant of the first cycle device 2 and the second refrigerant of the second cycle device 4 with each other. The second heat exchanger 40 may have the first refrigerant flow path 41 through which the first refrigerant passes and the second refrigerant flow path 42 through which the second refrigerant is heat-exchanged with the first refrigerant while passing. The second heat exchanger 40 may be configured as a dual-tube type heat exchanger or plate type heat exchanger in which the first and second refrigerants are heat-exchanged with each other with a heat transfer member interposed therebetween.

The second heat exchanger 40 may be connected to the first expansion mechanism 50 through a second heat exchanger-first expansion mechanism connecting line 43. The second heat exchanger-first expansion mechanism connecting line 43 may be connected to the first refrigerant flow path 41 of the second heat exchanger 40.

Referring to FIG. 4, the second heat exchanger 40 may include an outer body 47 provided with a second refrigerant inlet 44 and a second refrigerant outlet 45, the outer body 47 having an inner space 46 formed therein such that the second refrigerant passes through the outer body 47, and an inner tube 49 provided with a spiral tube portion 48 disposed in the inner space 46, the inner tube 49 having the first refrigerant passing therethrough while penetrating the outer body 47.

In the second heat exchanger 40, the first refrigerant flow path 41 through which the first refrigerant passes may be formed in the inner tube 49, and the second refrigerant flow path 42 through which the second refrigerant passes may be formed in the second refrigerant inlet 44, the space between the inner tube 49 and the outer body 47, and the second refrigerant outlet 45.

The first expansion mechanism 50 may expand the first refrigerant between the second and third heat exchangers 40 and 60. The first expansion mechanism 50 may be configured as a capillary tube or electronic expansion tube. The first expansion mechanism 50 may be connected to the third heat exchanger 60 through a first expansion mechanism-third heat exchanger connecting line 51.

In a heating operation of the heat pump, the third heat exchanger 60 may be an evaporator in which the first refrigerant expanded by the first expansion mechanism 50 is heat-exchanged with outdoor air Ao to be evaporated. In a cooling operation of the heat pump, the third heat exchanger 60 may be a condenser in which the first refrigerant compressed by the first compressor 10 is heat-exchanged with the outdoor air Ao to be condensed. The third heat exchanger 60 may be configured as a first refrigerant-air heat exchanger for heat-exchanging the first refrigerant with air. The third heat exchanger 60 may be an outdoor heat exchanger for heat-exchanging the outdoor air Ao with the first refrigerant. The third heat exchanger 60 may be configured as a fin-tube type heat exchanger including a refrigerant tube through which the first refrigerant passes and fins installed in the refrigerant tube.

In a heating operation of the heat pump, in the first cycle device 2, the first refrigerant may be exhausted from the first compressor 10 and heat-exhausted with the indoor air Ai to be condensed while passing through the first heat exchanger 30. Then, the first refrigerant may pass through the second heat exchanger 40. The first refrigerant passing through the second heat exchanger 40 may be expanded by the first expansion mechanism 50. Then, the first refrigerant may be heat-exchanged with the outdoor air Ao to be evaporated while passing through the third heat exchanger 60. The first refrigerant passing through the third heat exchanger 60 may be sucked into the first compressor 10. That is, the first heat exchanger 30 may function as a heat exchanger for heating the indoor air Ai.

In a cooling operation of the heat pump, in the first cycle device 2, the first refrigerant may be exhausted from the first compressor 10 and heat-exchanged with the outdoor air Ao to be condensed while passing through the third heat exchanger 60. Then, the first refrigerant may be expanded by the first expansion mechanism 50 and flowed into the first heat exchanger 30 after passing through the second heat exchanger 40. The first refrigerant flowed into the first heat exchanger 30 may be heat-exchanged with the indoor air Ai to be evaporated while passing through the first heat exchanger 30, and sucked into the first compressor 10. That is, the first heat exchanger 30 may be a heat exchanger for cooling the indoor air Ai. In a cooling operation of the heat pump, when the first cycle device 2 is operated, the second cycle device 4 may not be operated. The first refrigerant may pass through the second heat exchanger 40 while the heat-exchange of the first refrigerant is minimized.

The second cycle device 4 may be a freezing cycle device including a second compressor 110, a fourth heat exchanger 120, a second expansion mechanism 130, and the second heat exchanger 40.

The second cycle device 4 may be connected such that the second refrigerant is circulated in an order of the second compressor 110, the fourth heat exchanger 120, the second expansion mechanism 130, the second heat exchanger 40, and the second compressor 110. The second cycle device 4 may be a high-pressure cycle device for absorbing heat of the first cycle device in a heating operation of the first cycle device 2.

The second compressor 110 may suck the second refrigerant, compress the sucked refrigerant, and then exhaust the compressed refrigerant. A second compressor suction line 111 through which the second refrigerant is sucked into the second compressor 110 may be connected to the second compressor 110. One end of the second compressor suction line 111 may be connected to the second compressor 110, and the other end of the second compressor suction line 111 may be connected to the second heat exchanger 40. The second compressor suction line 111 may be connected to the second refrigerant flow path 42 of the second heat exchanger 40. The second refrigerant passing through the second heat exchanger 40 may be flowed into the second compressor 110 through the second compressor suction line 111, and compressed in the second compressor 110. An accumulator in which liquid refrigerant in the second refrigerant is contained may be installed in the second compressor suction line 111.

A second compressor exhaust line 112 through which the second refrigerant compressed by the second compressor 110 is exhausted may be connected to the second compressor 110. One end of the second compressor exhaust line 112 may be connected to the second compressor 110, and the other end of the second compressor exhaust line 112 may be connected to the fourth heat exchanger 120. The second compressor 110 may exhaust the second refrigerant into the second compressor exhaust line 112, and the second refrigerant exhausted into the second compressor exhaust line 112 may be guided into the fourth heat exchanger 120. An oil separator for separating oil mixed in the exhausted second refrigerant may be installed in the second compressor exhaust line 112.

The fourth heat exchanger 120 may be a preheater for heating the outdoor air Ao flowing toward the third heat exchanger 60 at a position prior to the third heat exchanger 60. The fourth heat exchanger 120 may be configured as a second refrigerant-outdoor air heat exchanger for heat-exchanging the second refrigerant with the outdoor air Ao. The fourth heat exchanger 120 may be disposed prior to the third heat exchanger 60 in the flow direction of the outdoor air Ao, and the outdoor air Ao may be flowed into the third heat exchanger 60 in a state in which the outdoor air Ao is heated while passing through the fourth heat exchanger 120.

The outdoor air Ao heated by the fourth heat exchanger 120 may heat up the third heat exchanger 60, and delay frost formation of the third heat exchanger 60 or defrost the third heat exchanger 60. The fourth heat exchanger 120 may be a condenser in which the second refrigerant is heat-exchanged with the outdoor air Ao. The fourth heat exchanger 120 may be connected to the second expansion mechanism 130 through a fourth heat exchanger-second expansion mechanism connecting line 121, and the second refrigerant condensed while passing through the fourth heat exchanger 120 may be guided into the second expansion mechanism 130 through the fourth heat exchanger-second expansion mechanism connecting line 121.

The second expansion mechanism 130 may expand the second refrigerant between the fourth heat exchanger 120 and the second heat exchanger 40. The second expansion mechanism 130 may expand the second refrigerant condensed in the fourth heat exchanger 120. The second expansion mechanism 130 may be configured as a capillary tube or electronic expansion tube. The second expansion mechanism 130 may be connected to the second heat exchanger 40 through a second expansion mechanism-second heat exchanger connecting line 131. The second expansion mechanism-second heat exchanger connecting line 131 may be connected to the second refrigerant flow path 42 of the second heat exchanger 40.

The second cycle device 4 may be a cascade cycle device connected to the first cycle device 2 through the second heat exchanger 40, and share the second heat exchanger 40 with the first cycle device 2. The second cycle device 4 may heat the outdoor air Ao flowing toward the third heat exchanger 60 by using heat absorbed in the second heat exchanger 40.

In a heating operation of the heat pump, in the second cycle device 4, the second refrigerant may be exhausted from the second compressor 110, heat-exchanged with the outdoor air Ao to be condensed while passing through the fourth heat exchanger 120, and then expanded by the second expansion mechanism 130. The second refrigerant expanded by the second expansion mechanism 130 may absorb heat of the first refrigerant and evaporated while passing through the second refrigerant flow path 42 of the second heat exchanger 40. The second refrigerant evaporated in the second refrigerant flow path 42 of the second heat exchanger 40 may be sucked into the second compressor 110.

In a cooling operation of the heat pump, in the second cycle device 4, the second compressor 110 may be stopped, and the second refrigerant may not circulate.

The heat pump includes an outdoor fan 190 for blowing the outdoor air Ao to sequentially pass through the fourth and third heat exchangers 120 and 60.

In a heating operation of the heat pump, the outdoor air Ao may absorb heat of the second refrigerant while primarily passing through the fourth heat exchanger 120, and then secondarily pass through the third heat exchanger 60. The outdoor air Ao heated up by the fourth heat exchanger 120 and then supplied to the third heat exchanger 60 may heat up the third heat exchanger 60 while passing through the third heat exchanger 60, and delay frost formation of the third heat exchanger 60 or defrost the third heat exchanger 60.

The fourth heat exchanger 120, the third heat exchanger 60, and the outdoor fan 190 may be sequentially disposed in the flow direction of the outdoor air Ao. In driving of the outdoor fan 190, the outdoor air Ao may sequentially pass through the fourth and third heat exchanger 120 and the third heat exchanger 60 and then be exhausted outdoors.

The fourth and third heat exchangers 120 and 60 may be disposed to be at least partially opposite to each other.

As shown in FIG. 3, the heat pump may include the outdoor unit O, and the first compressor 10, the third heat exchanger 60, the fourth heat exchanger 120, and the outdoor fan 190 may be disposed in the outdoor unit O. The fourth heat exchanger 120 may be disposed adjacent to the third heat exchanger 60. The fourth heat exchanger 120 may be disposed together with the third heat exchanger 60 in the outdoor unit O.

The heat pump may include one outdoor unit O. In this case, the first compressor 10, the 4-way valve 20, the second heat exchanger 40, the first expansion mechanism 50, the third heat exchanger 60, the second compressor 110, the fourth heat exchanger 120, and the second expansion mechanism 130 may be disposed together in the outdoor unit O.

The heat pump may include a plurality of outdoor units. In this case, the first compressor 10, the third heat exchanger 60, the fourth heat exchanger 120, and the outdoor fan 190 may be disposed together in a first outdoor unit among the plurality of outdoor units. The 4-way valve 20, the second heat exchanger 40, the first expansion mechanism 50, the second compressor 110, and the second expansion mechanism 130 may be disposed together in the first outdoor unit or disposed together in a second outdoor unit separated from the first outdoor unit.

Hereinafter, it is described as an example that the first compressor 10, the 4-way valve 20, the second heat exchanger 40, the first expansion mechanism 50, the third heat exchanger 60, the second compressor 110, the fourth heat exchanger 120, and the second expansion mechanism 130 are disposed together in one outdoor unit O.

The outdoor unit O may further include an outdoor-air suction body 202 provided with outdoor-air inlets 200 through which the outdoor air Ao is sucked into the inside of the outdoor unit O. The outdoor unit O may include an outdoor unit case 204 forming the external appearance thereof. The outdoor-air suction body 202 may be configured as a portion of the outdoor unit case 204. Alternatively, the outdoor-air suction body 202 may be configured separately from the outdoor unit case 204 and coupled to the outdoor unit case 204. The outdoor-air suction body 202 may include an outdoor suction grill through which the outdoor air Ao passes.

The outdoor unit O may be provided with outdoor-air outlets 206 through which the outdoor air Ao sequentially passing through the fourth and third heat exchangers 120 and 60 is exhausted to the outside of the outdoor unit O. The outdoor unit O may include an outdoor-air exhaust body 208 in which the outdoor-air outlets 206 are formed. The outdoor-air exhaust body 208 may be configured as a portion of the outdoor unit case 204. Alternatively, the outdoor-air exhaust body 208 may be configured separately from the outdoor unit case 204 and coupled to the outdoor unit case 204. The outdoor-air exhaust body 208 may include an outdoor exhaust grill through which the outdoor air Ao passes.

The fourth heat exchanger 120 may be at least partially opposite to the outdoor-air inlets 200. The fourth heat exchanger 120 may be at least partially disposed between the outdoor-air inlets 200 and the third heat exchanger 60.

The outdoor unit O may include a barrier 214 for partitioning the inside of the outdoor unit case 204 into a machine chamber 210 and a heat exchange chamber 212. The barrier 214 may be disposed inside the outdoor unit case 204.

The first and second compressors 10 and 110 shown in FIGS. 1 and 2 may be disposed in the machine chamber 210. The outdoor unit O may further include an outdoor unit controller for controlling various types of electronic components installed in the outdoor unit O. The outdoor unit controller can control the first and second compressors 10 and 110. That is, in the heat pump, one outdoor unit controller can control both the first compressor 10 of the first cycle device 2 and the second compressor 110 of the second cycle device 4.

The fourth and third heat exchangers 120 and 60 shown in FIGS. 1 and 2 may be disposed in the heat exchange chamber 212. The 4-way valve 20, the second heat exchanger 40, the first expansion mechanism 50, and the second expansion mechanism 130, which are shown in FIGS. 1 and 2, may be disposed in the machine chamber 210 or the heat exchange chamber 212.

In the heat pump, the first compressor 10 may be driven or stopped according to a load of the indoor unit I. In the heat pump, the first compressor 10 may be driven in the thermo ON of the indoor unit I and stopped in the thermo OFF of the indoor unit I.

In the heat pump, the second compressor 110 may be driven or stopped according to a defrosting condition or frost formation condition of the third heat exchanger 60. In order to minimize power consumption, the second compressor 110 may be driven under the defrosting condition or frost formation condition of the third heat exchanger 60 and otherwise stopped.

In the heat pump, the third heat exchanger 60 may be under the defrosting condition or frost formation condition while the indoor unit I heats the interior of the room as the first compressor 10 is driven. The second compressor 110 is not driven but may stand by for a setting time (first setting time) after the first compressor 10 starts driving. That is, the second compressor 110 may be driven after the setting time (first setting time) elapses after the first compressor 10 starts driving. Accordingly, it is possible to minimize unnecessary driving of the second compressor 110.

Meanwhile, the first compressor 10 may be driven or stopped according to the thermo ON or OFF of the indoor unit I. If the indoor unit I is thermo OFF while the second compressor 110 is driven, the second compressor 110 may be stopped earlier than the first compressor 10. That is, the first compressor 10 may be stopped after a setting time (second setting time) elapses after the second compressor 110 is stopped.

Hereinafter, an operation of the present disclosure will be described as follows.

First, in a case where the heat pump performs a heating operation and the second heat exchanger 30 is under a non-frost formation condition, the first compressor 10 may be driven, the second compressor 110 may be stopped, and the indoor and outdoor fans 180 and 190 may be driven. The heating operation may be an operation where the temperature of the interior of the room, in which the indoor unit I is installed, is equal to or lower than a thermo-ON temperature. In a case where the temperature of the interior of the room, in which the indoor unit I is installed, exceeds a thermo-OFF temperature, the heat pump may not perform the heating operation.

In the driving of the first compressor 10, the first refrigerant may be exhausted from the first compressor 10. The first refrigerant exhausted from the first compressor 10 may be condensed by being heat-exchanged with the indoor air Ai while passing through the first heat exchanger 30 via the 4-way valve 20. The first refrigerant condensed in the first heat exchanger 30 may pass through the second heat exchanger 40 and then be flowed into the first expansion mechanism 50 to be expanded by the first expansion mechanism 50. The first refrigerant expanded by the first expansion mechanism 50 may be evaporated by being heat-exchanged with the outdoor air Ao. The first refrigerant evaporated in the third heat exchanger 60 may be sucked into the compressor 10 by the 4-way valve 20.

In the driving of the first compressor 10, the second compressor 110 is stopped, and hence the second refrigerant may not be circulated in the second cycle device 4. In the heat pump, the first cycle device 2 may independently heat the interior of the room.

Meanwhile, in the heating operation of the heat pump, the third heat exchanger 60 may be under a frost formation condition or defrosting condition while being heat-exchanged with the outdoor air Ao. Here, the frost formation condition is a condition in which frost is to be formed on the third heat exchanger 60, and the defrosting condition is a condition in which the third heat exchanger 60 is to be defrosted because the frost was previously formed on the third heat exchanger 60.

The heating operation of the heat pump may be switched to a defrosting/heating operation in the middle of the heating operation. In the defrosting/heating operation of the heat pump, the second cycle device 4 may be operated together with the first cycle device 2.

In the driving of the first compressor 10, the second compressor 110 may be driven. In the driving of the second compressor 110, the second refrigerant may be circulated in the second cycle device 4. In the driving of the second compressor 110, the second refrigerant may be exhausted from the second compressor 110. The second refrigerant exhausted from the second compressor 110 may be condensed by being heat-exchanged with the outdoor air Ao while passing through the fourth heat exchanger 120. The second refrigerant condensed in the fourth heat exchanger 120 may be flowed into the second expansion mechanism 130 to be expanded by the second expansion mechanism 130. The second refrigerant expanded by the second expansion mechanism 130 may be flowed into the second heat exchanger 40. The second refrigerant flowed into the second heat exchanger 40 may absorb heat of the first refrigerant passing through the first refrigerant flow path 41 while passing through the second refrigerant flow path 42. Alternatively, the second refrigerant may be evaporated while passing through the second refrigerant flow path 42. The second refrigerant evaporated in the second heat exchanger 40 may be sucked into the second compressor 110.

In the second cycle device 4, in the driving of the second compressor 110, the heat absorbed in the second heat exchanger 40 may be transferred to the fourth heat exchanger 120. The heat transferred as described above may heat up the outdoor air Ao flowed toward the third heat exchanger 60. The outdoor air Ao heated up by the fourth heat exchanger 120 and then flowed into the third heat exchanger 60 may heat the third heat exchanger 60. Thus, the frost formation of the third heat exchanger 60 can be delayed, or the third heat exchanger 60 can be defrosted.

The frost formation delay or defrosting described above will be described in detail. In a case where the outdoor air Ao having a dry bulb temperature of 2, a wet bulb temperature of 1, and a humidity of 84% is flowed into the fourth heat exchanger 120, the outdoor air Ao may be heat-exchanged with the second refrigerant while passing through the fourth heat exchanger 120 to have a dry bulb temperature of 5, a wet bulb temperature of 2.7, and a humidity of 68%. The outdoor air Ao having the increased dry bulb temperature, the increased wet bulb temperature, and the decreased humidity may be flowed into the third heat exchanger 60 to pass through the third heat exchanger 60, and be heat-exchanged with the first refrigerant while passing through the third heat exchanger 60. The outdoor air Ao heat-exchanged with the first refrigerant while passing through the third heat exchanger 60 may have a dry bulb temperature of −0.7, a wet bulb temperature of −1.0, and a humidity of 94%. In the heat pump, the outdoor air Ao having the dry bulb temperature of 2, the wet bulb temperature of 1, and the humidity of 84% can delay frost formation of the third heat exchanger 60 or defrosting the third heat exchanger 60, as compared with when the outdoor air Ao is directly flowed into the third heat exchanger 60. Further, in the heat pump, the heating operation can be continued without any pause, thereby performing a more efficient heating operation.

Meanwhile, in a cooling operation of the heat pump, the first compressor 10 may be driven, the second compressor 110 may be stopped, and the indoor and outdoor fans 180 and 190 may be driven.

Here, the cooling operation of the heat pump may be an operation where the temperature of the interior of the room, in which the indoor unit I is installed, is equal to or higher than the thermo-ON temperature. In a case where the temperature of the interior of the room, in which the indoor unit I is installed, is less than the thermo-OFF temperature, the heat pump may not perform the cooling operation.

In the driving of the first compressor 10, the first refrigerant may be exhausted from the first compressor 10. The first refrigerant exhausted from the first compressor 10 may be condensed by being heat-exchanged with the outdoor air Ao while passing through the third heat exchanger 60 via the 4-way valve 20. The first refrigerant condensed in the third heat exchanger 60 may be flowed into the first expansion mechanism 50 to be expanded by the first expansion mechanism 50. The first refrigerant expanded by the first expansion mechanism 50 may pass through the second heat exchanger 40 without any heat exchange. The first refrigerant passing through the second heat exchanger 40 may be flowed into the first heat exchanger 30 to be evaporated by being heat-exchanged with the indoor air Ai. The first refrigerant evaporated in the first heat exchanger 30 may be sucked into the first compressor 10 by the 4-way valve 20.

Figure 5:
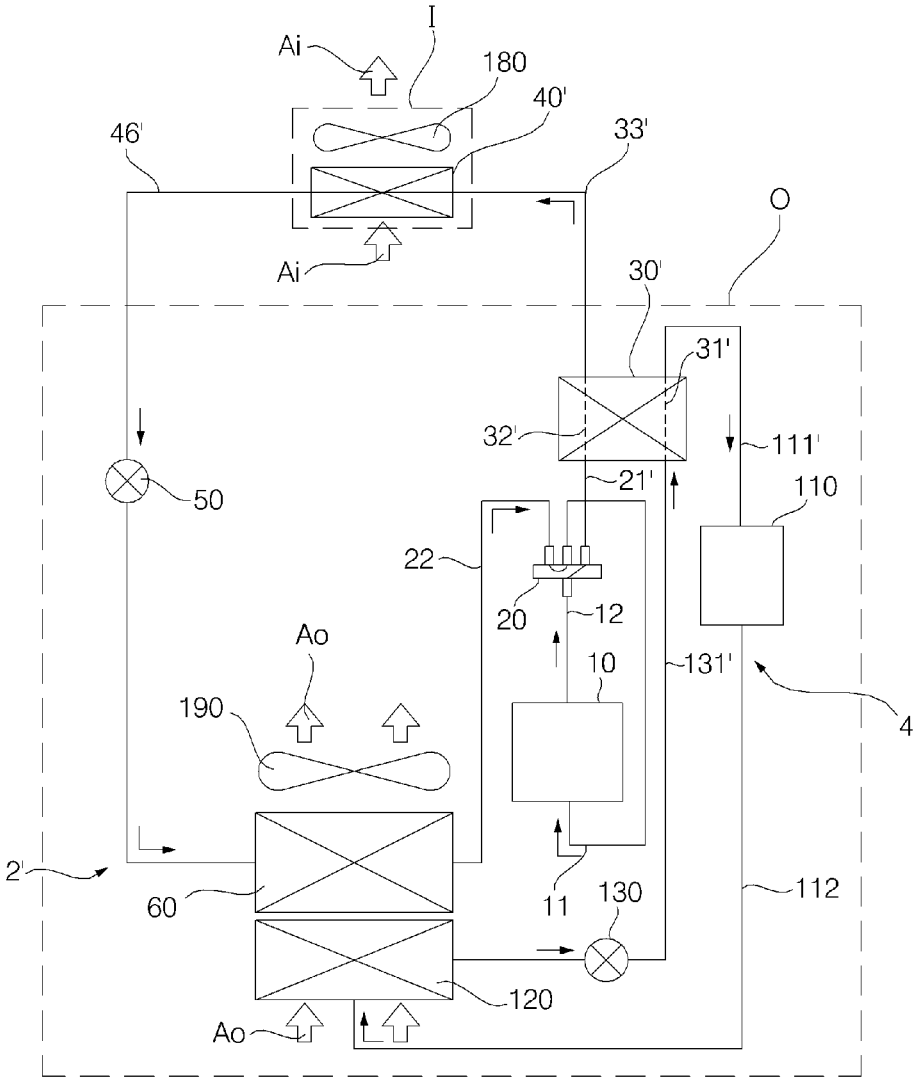
FIG. 5 is a diagram illustrating a flow of a refrigerant in a heating operation of a heat pump according to a second embodiment of the present disclosure.
Figure 6:
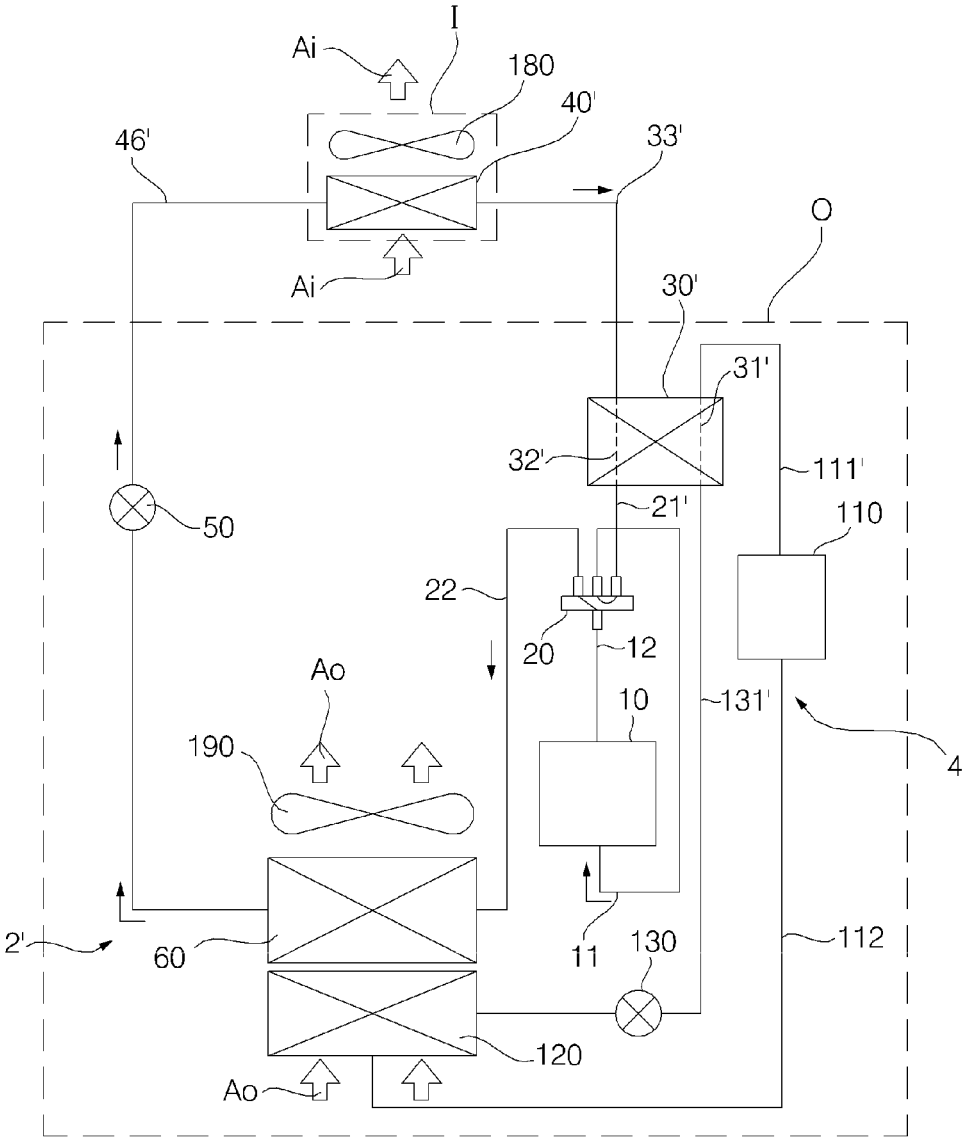
FIG. 6 is a diagram illustrating a flow of the refrigerant in a cooling operation of the heat pump according to the second embodiment of the present disclosure.
Figure 7:
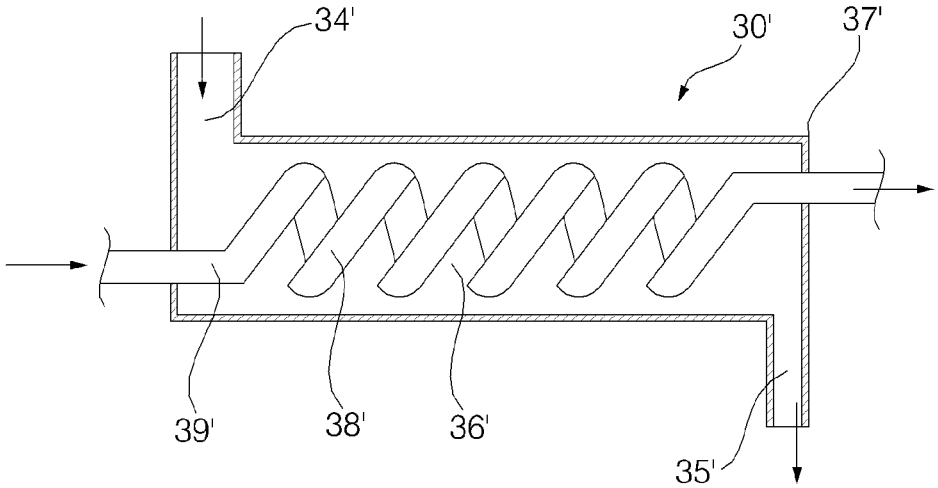
FIG. 7 is a diagram illustrating an inside of a first heat exchanger in the heat pump according to the second embodiment of the present disclosure.

FIG. 5 is a diagram illustrating a flow of a refrigerant in a heating operation of a heat pump according to a second embodiment of the present disclosure. FIG. 6 is a diagram illustrating a flow of the refrigerant in a cooling operation of the heat pump according to the second embodiment of the present disclosure. FIG. 7 is a diagram illustrating an inside of a first heat exchanger in the heat pump according to the second embodiment of the present disclosure.

The heat pump of this embodiment may include a first cycle device 2', a second cycle device 4, and an outdoor fan 190.

The first cycle device 2' may be a freezing cycle device including a first compressor 10, a 4-way valve 20, a first heat exchanger 30', a second heat exchanger 40', a first expansion mechanism 50, and a third heat exchanger 60.

In a heating operation of the heat pump, the first cycle device 2' may be connected such that a first refrigerant is circulated in an order of the first compressor 10, the 4-way valve 20, the first heat exchanger 30', the second heat exchanger 40', the first expansion mechanism 50, the third heat exchanger 60, the 4-way valve 20, and the first compressor 1. In a cooling operation of the heat pump, the first cycle device 2' may be connected such that the first refrigerant is circulated in an order of the first compressor 10, the 4-way valve 20, the third heat exchanger 60, the first expansion mechanism 50, the second heat exchanger 40', the first heat exchanger 30', the 4-way valve 20, and the first compressor 10.

The second cycle device 4 may be a freezing cycle device including a second compressor 110, a fourth heat exchanger 120, a second expansion mechanism 130, and the first heat exchanger 30'. The second cycle device 4 may be connected such that a second refrigerant is circulated in an order of the second compressor 110, the fourth heat exchanger 120, the second expansion mechanism 130, the first heat exchanger 30', and the second compressor 110.

In this embodiment, the first heat exchanger 30' may be a cascade heat exchanger for heat-exchanging the first and second refrigerants with each other, and the second heat exchanger 40' may be an indoor heat exchanger for heat-exchanging the first refrigerant and indoor air with each other or a heat exchanger for heat-exchanging the indoor air and water with each other.

In this embodiment, the configurations and operations of the other components except the first and second heat exchangers 30' and 40' are identical or similar to those of the first embodiment. Therefore, like reference numerals are used and their description will be omitted.

The heat pump of this embodiment may include an indoor fan 180 for blowing indoor air Ai to the second heat exchanger 40', and the second heat exchanger 40' may be an indoor heat exchanger for heat-exchanging the indoor Ai and the first refrigerant with each other.

The function and structure of the first heat exchanger 30' may be identical or similar to those of the second heat exchanger 40 of the first embodiment. The first heat exchanger 30' may be installed in an outdoor unit O instead of an indoor unit I.

The first heat exchanger 30' may have a first refrigerant flow path 31' through which the first refrigerant passes and a second refrigerant flow path 32' through which the second refrigerant is heat-exchanged with the first refrigerant while passing.

The first heat exchanger 30' may be connected to the 4-way valve 20 through a 4-way valve-first heat exchanger connecting line 21'. One end of the 4-way valve-first heat exchanger connecting line 21' may be connected to the 4-way valve 20, and the other end of the 4-way valve-first heat exchanger connecting line 21' may be connected to the first refrigerant flow path 31'.

The first heat exchanger 30' may be connected to the second heat exchanger 40' through a first heat exchanger-second heat exchanger connecting line 33'. One end of the first heat exchanger-second heat exchanger connecting line 33' may be connected to the first refrigerant flow path 31', and the other end of the first heat exchanger-second heat exchanger connecting line 33' may be connected to the second heat exchanger 40'.

The first heat exchanger 30' may be configured as a dual-tube type heat exchanger or plate type heat exchanger in which the first and second refrigerants are heat-exchanged with each other with a heat transfer member interposed therebetween.

As shown in FIG. 7, the first heat exchanger 30' may include an outer body 37' provided with a second refrigerant inlet 34' and a second refrigerant outlet 35', the outer body 37' having an inner space 36' formed therein such that the second refrigerant passes through the outer body 37', and an inner tube 39' provided with a spiral tube portion 38' disposed in the inner space 36', the inner tube 39' having the first refrigerant passing therethrough while penetrating the outer body 37'.

In the first heat exchanger 30', the first refrigerant flow path 31' through which the first refrigerant passes may be formed in the inner tube 39', and the second refrigerant flow path 32' through which the second refrigerant passes may be formed in the second refrigerant inlet 34', the space between the inner tube 39' and the outer body 37', and the second refrigerant outlet 35'.

The function and structure of the second heat exchanger 40' may be identical or similar to those of the first heat exchanger 30 of the first embodiment. The second heat exchanger 40' may be installed in the indoor unit I instead of the outdoor unit O. The second heat exchanger 40' may be installed together with the indoor fan 180 in the indoor unit I.

The second heat exchanger 40' may be connected to the first expansion mechanism 50 through a second heat exchanger-first expansion mechanism connecting line 43'.

In this embodiment, in driving of the first and second compressors 10 and 110, heat of the high-temperature, high-pressure first refrigerant compressed by the first compressor 10 may be transferred from the first heat exchanger 30' to the second refrigerant. In the second cycle device 4, the heat absorbed as described above may be transferred to the fourth heat exchanger 120. Like the first embodiment, the fourth heat exchanger 120 may heat up outdoor air Ao flowed toward the third heat exchanger 60 to delay frost formation of the third heat exchanger 60 or defrost the third heat exchanger 60.

In this embodiment, high-temperature heat can be absorbed in the second cycle device 4 as compared with the first embodiment. In this embodiment, the fourth heat exchanger 120 can heat up the outdoor air Ao to a high temperature as compared with the first embodiment. Further, it is possible to quickly defrost the third heat exchanger 60 or delay frost formation of the third heat exchanger 60.

The disclosure has been made in an effort to provide a heat pump capable of continuously performing a heating operation at high efficiency.

It is to be understood that technical problems to be solved by the present disclosure are not limited to the aforementioned technical problems and other technical problems which are not mentioned will be apparent from the above description to the person with an ordinary skill in the art to which the present disclosure pertains.

A heat pump includes a first cycle device connected such that, in a heating operation, a first refrigerant is circulated in an order of a first compressor, a 4-way valve, a first heat exchanger, a second heat exchanger, a first expansion mechanism, a third heat exchanger, the 4-way valve, and the first compressor, and such that, in a cooling operation, the first refrigerant is circulated in an order of the first compressor, the 4-way valve, the third heat exchanger, the first expansion mechanism, the second heat exchanger, the first heat exchanger, the 4-way valve, and the first compressor; and a second cycle device connected such that a second refrigerant is circulated in an order of a second compressor, a fourth heat exchanger, a second expansion mechanism, the second heat exchanger, and the second compressor, wherein the second heat exchanger is a first refrigerant-second refrigerant heat exchanger having a first refrigerant flow path through which the first refrigerant passes and a second refrigerant flow path through which the second refrigerant is heat-exchanged with the first refrigerant while passing, and wherein the heat pump further includes an outdoor fan configured to blow outdoor air to sequentially pass through the fourth heat exchanger and the third heat exchanger.

The fourth heat exchanger and the third heat exchanger may be disposed to be at least partially opposite to each other.

The outdoor fan, the first compressor, the fourth heat exchanger, and the third heat exchanger may be disposed in an outdoor unit.

The outdoor unit may further include an outdoor-air suction body provided with outdoor-air inlets through which the outdoor air is sucked into the inside of the outdoor unit. The fourth heat exchanger may be at least partially opposite to the outdoor-air inlets.

The outdoor unit may further include an outdoor-air suction body provided with outdoor-air inlets through which the outdoor air is sucked into the inside of the outdoor unit. The fourth heat exchanger may be at least partially disposed between the out-door inlets and the third heat exchanger.

The outdoor unit may include a barrier configured to partition the inside of the outdoor unit into a machine chamber and a heat exchange chamber. The first compressor and the second compressor may be disposed in the machine chamber. The fourth heat exchanger and the third heat exchanger may be disposed in the heat exchange chamber.

The heat pump may further include an indoor fan configured to blow indoor air to the first heat exchanger. The first heat exchanger may be an indoor heat exchanger in which the indoor air and the first refrigerant are heat-exchanged with each other. The second heat exchanger may have the first refrigerant flow path and the second refrigerant flow path, and the first refrigerant flow path may be connected to the first heat exchanger through a first heat exchanger-second heat exchanger connecting line.

The first heat exchanger may be a hot-water supply heat exchanger to which a water pipe is connected such that water and the first refrigerant are heat-exchanged with each other. The second heat exchanger may have the first refrigerant flow path and the second refrigerant flow path, and the first refrigerant flow path may be connected to the first heat exchanger through a first heat exchanger-second heat exchanger connecting line.

The second heat exchanger may include an outer body provided with a second refrigerant inlet and a second refrigerant outlet, the outer body having an inner space formed therein such that the second refrigerant passes through the outer body; and an inner tube provided with a spiral tube portion disposed in the inner space, the inner tube having the first refrigerant passing therethrough while penetrating the outer body.

The second compressor may be stopped in the cooling operation of the first cycle device. If the first cycle device may perform the heating operation and the third heat exchanger is under a defrosting condition or frost formation condition of the third heat exchanger, the second compressor may be driven.

A heat pump includes a first cycle device connected such that, in a heating operation, a first refrigerant is circulated in an order of a first compressor, a 4-way valve, a first heat exchanger, a second heat exchanger, a first expansion mechanism, a third heat exchanger, the 4-way valve, and the first compressor, and such that, in a cooling operation, the first refrigerant is circulated in an order of the first compressor, the 4-way valve, the third heat exchanger, the first expansion mechanism, the second heat exchanger, the first heat exchanger, the 4-way valve, and the first compressor; and a second cycle device connected such that a second refrigerant is circulated in an order of a second compressor, a fourth heat exchanger, a second expansion mechanism, the second heat exchanger, and the second compressor, wherein the first heat exchanger is a first refrigerant-second refrigerant heat exchanger having a first refrigerant flow path through which the first refrigerant passes and a second refrigerant flow path through which the second refrigerant is heat-exchanged with the first refrigerant while passing, and wherein the heat pump further comprises an outdoor fan configured to blow outdoor air to sequentially pass through the fourth heat exchanger and the third heat exchanger.

The fourth heat exchanger and the third heat exchanger may be disposed to be at least partially opposite to each other.

The outdoor fan, the first compressor, the fourth heat exchanger, and the third heat exchanger may be disposed in an outdoor unit.

The outdoor unit may further include an outdoor-air suction body provided with outdoor-air inlets through which the outdoor air is sucked into the inside of the outdoor unit. The fourth heat exchanger may be at least partially opposite to the outdoor-air inlets.

The outdoor unit may further include an outdoor-air suction body provided with outdoor-air inlets through which the outdoor air is sucked into the inside of the outdoor unit. The fourth heat exchanger may be at least partially disposed between the out-door inlets and the third heat exchanger.

The outdoor unit may include a barrier configured to partition the inside of the outdoor unit into a machine chamber and a heat exchange chamber. The first compressor and the second compressor may be disposed in the machine chamber. The fourth heat exchanger and the third heat exchanger may be disposed in the heat exchange chamber.

The heat pump may further include an indoor fan configured to blow indoor air to the second heat exchanger. The second heat exchanger may be an indoor heat exchanger in which the indoor air and the first refrigerant are heat-exchanged with each other. The first heat exchanger may have the first refrigerant flow path and the second refrigerant flow path, and the first refrigerant flow path may be connected to the second heat exchanger through a first heat exchanger-second heat exchanger connecting line.

The second heat exchanger may be a hot-water supply heat exchanger to which a water pipe is connected such that water and the first refrigerant are heat-exchanged with each other. The first heat exchanger may have the first refrigerant flow path and the second refrigerant flow path, and the first refrigerant flow path may be connected to the second heat exchanger through a first heat exchanger-second heat exchanger connecting line.

The first heat exchanger may include an outer body provided with a second refrigerant inlet and a second refrigerant outlet, the outer body having an inner space formed therein such that the second refrigerant passes through the outer body; and an inner tube provided with a spiral tube portion disposed in the inner space, the inner tube having the first refrigerant passing therethrough while penetrating the outer body.

The second compressor may be stopped in the cooling operation of the first cycle device. If the first cycle device performs the heating operation and the third heat exchanger is under a defrosting condition or frost formation condition of the third heat exchanger, the second compressor may be driven.

According to the present disclosure, it is possible to continuously heat the interior of a room while delaying frost formation of or defrosting the third heat exchanger heat-exchanged with outdoor air at high efficiency.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heat pump comprising:

a first compressor to circulate a first refrigerant;

a first valve coupled to the first compressor;

a first heat exchanger coupled to the first valve;

a second heat exchanger coupled to the first heat exchanger;

a first expansion mechanism coupled to the second heat exchanger;

a third heat exchanger coupled to the first expansion mechanism and the first valve;

a second compressor to circulate a second refrigerant and coupled to the second heat exchanger;

a fourth heat exchanger coupled to the second compressor; and a second expansion mechanism coupled to the second heat exchanger, wherein the second heat exchanger includes a first refrigerant flow path through which the first refrigerant passes and a second refrigerant flow path through which the second refrigerant passes to allow heat-exchange with the first refrigerant during a heating operation of the heat pump, and the heat pump further includes a first fan configured to blow air to allow the air to sequentially pass through the fourth heat exchanger and the third heat exchanger, and wherein the second refrigerant compressed in the second compressor flows into the fourth heat exchanger, and outdoor air which is heated while passing through the fourth heat exchanger flows into the third heat exchanger during the heating operation.

2. The heat pump of claim 1, wherein the fourth heat exchanger and the third heat exchanger are provided to be at least partially opposite to each other.

3. The heat pump of claim 1, wherein the first fan, the first compressor, the fourth heat exchanger, and the third heat exchanger are disposed in an outdoor unit.

4. The heat pump of claim 3, wherein the outdoor unit further includes a body provided with outdoor-air inlets through which the outdoor air is sucked into the inside of the outdoor unit, and the fourth heat exchanger is at least partially opposite to the outdoor-air inlets.

5. The heat pump of claim 3, wherein the outdoor unit further includes a body provided with outdoor-air inlets through which the outdoor air is sucked into the inside of the outdoor unit, and the fourth heat exchanger is at least partially provided between the outdoor-air inlets and the third heat exchanger.

6. The heat pump of claim 3, wherein the outdoor unit includes a barrier configured to partition the inside of the outdoor unit into a machine chamber and a heat exchange chamber, wherein the first compressor and the second compressor are provided in the machine chamber, and wherein the fourth heat exchanger and the third heat exchanger are provided in the heat exchange chamber.

7. The heat pump of claim 1, further comprising a second fan configured to blow indoor air to the first heat exchanger, wherein the first heat exchanger is an indoor heat exchanger in which the indoor air and the first refrigerant are heat-exchanged with each other, and wherein the second heat exchanger has the first refrigerant flow path and the second refrigerant flow path, and the first refrigerant flow path is connected to the first heat exchanger through a first heat exchanger-second heat exchanger connecting line.

8. The heat pump of claim 1, wherein the first heat exchanger is a hot-water supply heat exchanger to which a water pipe is connected such that water and the first refrigerant are heat-exchanged with each other, and wherein the second heat exchanger has the first refrigerant flow path and the second refrigerant flow path, and the first refrigerant flow path is connected to the first heat exchanger through a first heat exchanger-second heat exchanger connecting line.

9. The heat pump of claim 1, wherein the second heat exchanger comprises:

an outer body provided with a second refrigerant inlet and a second refrigerant outlet, the outer body having an inner space formed therein such that the second refrigerant passes through the inner space; and a spiral inner tube provided in the inner space of the outer body, the first refrigerant passing through the spiral inner tube.

10. The heat pump of claim 1, wherein the second compressor is stopped during a cooling operation of the heat pump, and during the heating operation, the second compressor is driven when the third heat exchanger is under a defrosting condition or frost formation condition.

11. A heat pump comprising:

a first compressor to circulate a first refrigerant;

a first valve coupled to the first compressor;

a first heat exchanger coupled to the first valve;

a second heat exchanger coupled to the first heat exchanger;

a first expansion mechanism coupled to the second heat exchanger;

a third heat exchanger coupled to the first expansion valve and the first valve; a second compressor to circulate a second refrigerant;

a fourth heat exchanger coupled to the second compressor; and a second expansion mechanism coupled to the first heat exchanger, wherein the first heat exchanger includes a first refrigerant flow path through which the first refrigerant passes from the first valve to the second heat exchanger and a second refrigerant flow path through which the second refrigerant passes from the second expansion mechanism to the second compressor such that there is a heat exchange between the first refrigerant and the second refrigerant in the first heat exchanger during a heating operation of the heat pump, and the heat pump further includes a first fan configured to blow air to allow the air to sequentially pass through the fourth heat exchanger and the third heat exchanger, and wherein the fourth heat exchanger and the third heat exchanger are adjacent to each other.

12. The heat pump of claim 11, wherein the fourth heat exchanger and the third heat exchanger are provided to be at least partially opposite to each other.

13. The heat pump of claim 11, wherein the first fan, the first compressor, the fourth heat exchanger, and the third heat exchanger are provided in an outdoor unit.

14. The heat pump of claim 13, wherein the outdoor unit includes a body provided with outdoor-air inlets through which the outdoor air is sucked into the inside of the outdoor unit, and the fourth heat exchanger is provided at least partially opposite to the outdoor-air inlets.

15. The heat pump of claim 13, wherein the outdoor unit includes a body provided with outdoor-air inlets through which the outdoor air is sucked into the inside of the outdoor unit, and the fourth heat exchanger is at least partially provided between the out-door inlets and the third heat exchanger.

16. The heat pump of claim 13, wherein the outdoor unit includes a barrier configured to partition the inside of the outdoor unit into a machine chamber and a heat exchange chamber, wherein the first compressor and the second compressor are provided in the machine chamber, and wherein the fourth heat exchanger and the third heat exchanger are provided in the heat exchange chamber.

17. The heat pump of claim 11, further comprising a second fan configured to blow indoor air to the second heat exchanger, wherein the second heat exchanger is an indoor heat exchanger in which the indoor air and the first refrigerant are heat-exchanged with each other, and wherein the first heat exchanger has the first refrigerant flow path and the second refrigerant flow path, and the first refrigerant flow path is connected to the second heat exchanger through a first heat exchanger-second heat exchanger connecting line.

18. The heat pump of claim 11, wherein the second heat exchanger is a hot-water supply heat exchanger to which a water pipe is connected such that water and the first refrigerant are heat-exchanged with each other, and wherein the first heat exchanger has the first refrigerant flow path and the second refrigerant flow path, and the first refrigerant flow path is connected to the second heat exchanger through a first heat exchanger-second heat exchanger connecting line.

19. The heat pump of claim 11, wherein the first heat exchanger comprises:

an outer body provided with a second refrigerant inlet and a second refrigerant outlet, the outer body having an inner space formed therein such that the second refrigerant passes through the outer body; and a spiral inner tube provided in the inner space, the spiral inner tube having the first refrigerant passing therethrough while penetrating the outer body.

20. The heat pump of claim 11, wherein the second compressor is stopped in the cooling operation of the heat pump, and during the heating operation, the second compressor is driven when the third heat exchanger is under a defrosting condition or frost formation condition.

* * * * *